US010836984B2

(12) United States Patent
Fang et al.

(10) Patent No.: US 10,836,984 B2
(45) Date of Patent: Nov. 17, 2020

(54) METHOD FOR STABILIZING BOTH LIPASE AND PROTEASE IN LIQUID ENZYMATIC LAUNDRY DETERGENT

(71) Applicant: Jiangnan University, Jiangsu (CN)

(72) Inventors: Yun Fang, Wuxi (CN); Yongmei Xia, Jiangsu (CN); Bei Wei, Jiangsu (CN); Yinxing Yan, Jiangsu (CN)

(73) Assignee: Jiangnan University, Wuxi (CN)

( * ) Notice: Subject to any disclaimer, the term of this patent is extended or adjusted under 35 U.S.C. 154(b) by 259 days.

(21) Appl. No.: 15/887,970

(22) Filed: Feb. 2, 2018

(65) Prior Publication Data

US 2018/0320112 A1 Nov. 8, 2018

(30) Foreign Application Priority Data

May 4, 2017 (CN) ..... 2017 1 0307814
May 15, 2017 (CN) ..... 2017 1 0339854

(51) Int. Cl.

| | |
|---|---|
| ***C11D 17/00*** | (2006.01) |
| ***C11D 3/386*** | (2006.01) |
| ***C11D 3/34*** | (2006.01) |
| ***C11D 3/20*** | (2006.01) |

(52) U.S. Cl.

CPC ..... *C11D 17/0039* (2013.01); *C11D 3/2079* (2013.01); *C11D 3/2086* (2013.01); *C11D 3/349* (2013.01); *C11D 3/38618* (2013.01); *C11D 3/38627* (2013.01); *C11D 3/38663* (2013.01); *C11D 17/0008* (2013.01)

(58) Field of Classification Search

CPC . C11D 3/395; C11D 3/38627; C11D 3/38663; C11D 3/38618; C11D 3/2086; C11D 3/2079; C11D 3/349; C11D 17/0039; C11D 17/0009; C11D 17/0008; A61L 2/088

See application file for complete search history.

(56) References Cited

U.S. PATENT DOCUMENTS

| | | | | |
|---|---|---|---|---|
| 8,119,385 | B2 * | 2/2012 | Mathur | C12N 9/00 435/212 |
| 8,957,010 | B2 * | 2/2015 | Wang | C11D 3/42 510/475 |
| 8,969,284 | B2 * | 3/2015 | Wang | C11D 3/0036 510/276 |
| 2003/0148013 | A1 * | 8/2003 | Jobe | A23K 40/30 426/635 |
| 2003/0210964 | A1 * | 11/2003 | Fitzgerald | B23F 5/22 409/11 |
| 2010/0234259 | A1 * | 9/2010 | Batchelor | C11D 3/0063 510/103 |
| 2015/0210964 | A1 * | 7/2015 | Willey | C11D 3/3953 424/665 |

* cited by examiner

*Primary Examiner* — Gregory R Delcotto
*Assistant Examiner* — Preeti Kumar
(74) *Attorney, Agent, or Firm* — Wayne & Ken, LLC; Tony Hom

(57) ABSTRACT

This disclosure provides a method for stabilizing both lipase and protease in liquid enzymatic laundry detergent, comprising steps of: first, self-assembling conjugated linoleic acid with protease and lipase, respectively, to form vesicles encapsulated protease and vesicles encapsulated lipase at a low $Ca^{2+}$ concentration; then, mixing the solution of vesicles encapsulated protease and the solution of vesicles encapsulated lipase, and then partially cross-linking conjugated linoleic acid molecules on the vesicles' surface. The obtained enzyme vesicles, after being concentrated, can be used directly in liquid laundry detergent. The lipase in the liquid laundry detergent will not be degraded by protease, and the enzymes in vesicles are able to resist against surfactant inhibition. Thus, the enzyme activities can be maintained in the liquid laundry detergent, and the enzymatic vesicles will be broken to release enzymes, when the liquid laundry detergent is used at a higher $Ca^{2+}$ concentration such as in tap water.

9 Claims, No Drawings

METHOD FOR STABILIZING BOTH LIPASE AND PROTEASE IN LIQUID ENZYMATIC LAUNDRY DETERGENT

TECHNICAL FIELD

The present disclosure relates to the technical field of daily chemical industry, and in particular to a method for stabilizing both lipase and protease in liquid enzymatic laundry detergent.

BACKGROUND

Liquid laundry detergents are rich in anionic, amphoteric and non-ionic surfactants, wherein the anionic surfactants serve as the main decontamination component. To improve washing performance of liquid laundry detergents, it is necessary to add protease into the liquid laundry detergent formulae to effectively remove protein stains such as blood stains, and adding lipase to remove grease stains. Therefore, alkaline lipase and protease are two enzymes commonly used in liquid enzymatic laundry detergents.

There are two issues in enzymes' stability in liquid enzymatic laundry detergents. Firstly, protease and lipase need to be separated in the liquid since lipase can be degraded by protease. Secondly, enzymes are much less stable in liquid laundry detergents than in powdery laundry detergents. Generally, at most 40%-50% of the enzyme activity can be remained after being kept with stabilizers in liquid laundry detergents for 8 weeks at room temperature. It is hard to keep enzymes stably in liquid laundry detergents containing a large amount of water and anionic surfactants, not as them stayed in powdery laundry detergents. Instead, in such an environment, enzymes tend to be affected by surfactants and bleachers in the formulae. Thus, for liquid enzymatic laundry detergents, it is necessary to prevent lipase from degradation by protease, in addition to the impact of surfactants, temperature and pH.

Adding stabilizers into liquid laundry detergents can slow down enzyme deactivation in a period of time. As common stabilizers for protease in the liquid laundry detergents, glycerol, sorbitol, diatomite or other synthetic stabilizers are used. In most of the formulae, at most 40%-50% of the initial enzyme activity can be remained in 8 weeks even in the presence of these stabilizers. Therefore it is required to add a larger amount of protease or lipase in the liquid laundry detergent, and it is difficult to keep protease and lipase simultaneously in a liquid laundry detergent.

Another way to stabilize enzymes is to enclose protease and lipase, respectively, with film-forming material. This can also improve the stability of protease and lipase during the shelf-life. For example, protease and lipase are enclosed by polysaccharides of high molecular weight, such as guar gum or alginic acid (or salts thereof). These methods are still not ideal although they are able to stabilize protease and lipase in liquid laundry detergents to some extent, because systems having protease encapsulated or surface-immobilized by alginates or the like usually decrease the enzyme activity and it takes 30 minutes to release half of the enzyme activity, which is far beyond the usual domestic laundering time. Furthermore, systems encapsulated enzymes by gel, such as alginates, are too large in size and thus not ideal for liquid laundry detergents.

In summary, how to avoid the degradation of lipase by protease is the key issue for liquid enzymatic laundry detergents. Moreover, in enzymatic liquid laundry detergents, in addition to keeping stable enzyme activity, an ideal enzyme encapsulated system should also be stable in liquid laundry detergent and can be rapidly broken in washing condition.

SUMMARY

The present disclosure provides a method for stabilizing both lipase and protease in liquid enzymatic laundry detergent, with a high encapsulation rate and a large encapsulated volume. By this method, lipase and protease are separately stored in the liquid laundry detergent so that the lipase will not be degraded by protease. Also, the enzymatic vesicles are able to resist against the inhibition of surfactants on the enzyme activity. Thus, both protease and lipase can maintain their enzyme activities in the liquid laundry detergent, and the enzymatic vesicles will be broken to release protease and lipase, respectively, when the liquid enzymatic laundry detergent is used at a higher $Ca^{2+}$ concentration, for example, when used in tap water.

In the present disclosure, protease vesicles and lipase vesicles which are stable in a liquid laundry detergent are respectively prepared, by using the partially cross-linked conjugated linoleic acid as vesicle material. The protease vesicles and lipase vesicles are stable in the liquid laundry detergent, and will be rapidly broken to release protease and lipase in the washing condition, respectively. The working principle will be described below.

The conjugated linoleates in the present disclosure belong to fatty acid salts, i.e., soaps, and are good anionic surfactant and compatible with amphoteric and anionic surfactants in liquid laundry detergent. Fatty acids (or salts thereof) can form fatty acid vesicles alone or in the presence of cosurfactants in specific conditions, and therefore are expected to be excellent vesicle material. Fatty acid vesicles, especially unsaturated fatty acid vesicles, are liposome colloidal dispersing systems and are rare bioactive molecular carriers that are safe and human-compatible.

There have been a great number of studies worldwide on the vesicle formation of unsaturated fatty acids such as oleic acids and on the molecular mechanism of biological effects. However, technical studies on the stabilization of vesicles are still in infancy. This is because, usually, fatty acids (or salts thereof) are self-assembled to form vesicles only at a pH close to their pKa, and they are only stable in a short period of time even in an ordinary condition without encapsulation. Moreover, it is a great challenge to stabilize the vesicles in different application conditions, let alone the problem of adaptability of the cavity volume.

Conjugated linoleic acid has beneficial physiological activity. Therefore, to date, there have been many reports on the method of encapsulated conjugated linoleic acid as the core material by microcapsules. Commonly, Arabic gum, gelatin, cross-linked protein or the like is used as wall material and microcapsules are prepared by spray drying to enclose conjugated linoleic acid. These methods are used for preparing oral health care products of conjugated linoleic acid and are thus not suitable for the preservation of protease and lipase in liquid laundry detergents.

On the other hand, conjugated linoleic acid can be partially cross-linked under certain circumstances. The cross-linked conjugated linoleic acid possibly have properties of both linoleic acids and macromolecules and also possibly form vesicles as wall material under certain circumstances, and are compatible with surfactants in the liquid laundry detergents. However, it is still a challenge to form enzyme-carried vesicles which can encapsulate enzymes and maintain the stabilities of vesicles and enzymes in liquid laundry detergents, and then can be broken in washing condition, wherein conjugated linoleic acid serves as wall material rather than core material.

It has been found in experiments that, after conjugated linoleic acid molecules are self-assembled to form vesicles, larger and more stable vesicles can be obtained by partially cross-linking conjugated linoleic acid, i.e., partially cross-linked conjugated linoleic acid vesicles. Such partially cross-linked conjugated linoleic acid vesicles are more stable than the conjugated linoleic acid vesicles and cross-linked conjugated linoleic acid vesicles mixed with oleic acid, and the pH range for stable vesicles is expanded. In addition, vesicles having a cavity volume which is one order of magnitude bigger than a cavity volume without $Ca^{2+}$ induction can be prepared at a low $Ca^{2+}$ concentration (for example, at a water hardness lower than 50 ppm calculated in form of calcium carbonate). The most significance is that the vesicles, which are formed in a certain range of cross-linking degree, in a certain range of pH and at a relative low $Ca^{2+}$ concentration, are stable at such a low $Ca^{2+}$ concentration but will be broken at a desired high $Ca^{2+}$ concentration (for example, at a water hardness higher than 90 ppm calculated in form of calcium carbonate, that is, under normal washing conditions, i.e., in domestic tap water). Usually, liquid laundry detergent formulae do not contain intentionally added $Ca^{2+}$, while in the washing condition, the hardness of tap water is generally 100-250 ppm (calculated in form of calcium carbonate). This provides a possibility to develop enzyme-carried vesicles which satisfy the aforementioned requirements, use the cross-linked conjugated linoleic acid vesicles as the wall material to respectively enclose protease and lipase, maintain their stability in liquid laundry detergents, and can be broken to release protease and lipase in tap water.

The present disclosure provides a method for stabilizing both lipase and protease in liquid enzymatic laundry detergent, comprising the steps of: first, self-assembling conjugated linoleic acid with protease and lipase, respectively, to respectively obtain vesicles encapsulated protease and vesicles encapsulated lipase at a certain pH and a relatively low $Ca^{2+}$ concentration; and then partially cross-linking conjugated linoleic acid on the vesicles' surface. The obtained solution of enzymatic vesicles, after being concentrated, can be used directly in a liquid laundry detergent formula. The enzymatic vesicles obtained in this way are able to resist against the inhibition of high-concentration surfactants on the enzyme activity, and can be broken to release protease and lipase, respectively, when the liquid laundry detergent is used at a higher $Ca^{2+}$ concentration, for example, when used in tap water. The method of the present disclosure can be applicable to both neutral and alkaline enzymes.

The technical solutions of the present disclosure will be described below.

A method for stabilizing both protease and lipase in liquid enzymatic laundry detergent specifically comprises: a step (a) of dissolving and homogenizing a certain amount of conjugated linoleic acid and calcium salt in a buffer solution at room temperature; adding the protease solution and lipase solution respectively into the conjugated linoleic acid and calcium salt buffer solution, mixing the solutions well, respectively; and shaking the two solutions by a shaker at a certain temperature for a certain period of time; and obtaining a solution of conjugated linoleic acid vesicles encapsulated protease and a solution of conjugated linoleic acid vesicles encapsulated lipase, respectively, until the encapsulation rate in either solution is no longer increased; and placing the two solutions together in a cylindrical glass reactor (height-diameter ratio of 2:1) equipped with a stopper and a magnetic stirrer; adding a certain amount of [3-(3,4-dimethyl-9-oxo-9-hydro-thioxanthene-2-oxy)-2-hydroxypropyl] trimethylammonium chloride (QTX) solution and conducting nitrogen sweeping into the reactor for 20-25 minutes in dark, sealing the reactor; stirring the solution while radiating by an ultraviolet spot light at a certain temperature to partially cross-link conjugated linoleic acid until a desired cross-linking degree has been reached, to thus obtain a solution of partially cross-linked conjugated linoleic acid vesicles encapsulated the enzymes.

The obtained solution of enzymatic vesicles can be used directly in liquid laundry detergents. The enclosed protease and lipase will be directly released in a washing environment, thereby prolonging the shelf-life of enzymes in the liquid laundry detergents.

"A certain amount of conjugated linoleic acid and calcium salts" mentioned above means that the final concentration of the conjugated linoleic acid solution is 200-600 $mmol \cdot L^{-1}$ (55.6-139 $g \cdot L^{-1}$). The final concentration of the calcium salts is 0.1-0.30 $mmol \cdot L^{-1}$, preferably 0.2 $mmol \cdot L^{-1}$.

"A buffer solution at a certain pH" mentioned above is a buffer solution at a concentration of 0.01 $mol \cdot L^{-1}$ and a pH of 7.0-10.0. No specific requirements are proposed on anions in the buffer solution (except for acetates), and systems containing citric acids or citrates are preferred. However, cations in the buffer solution should not be ions other than sodium ions, potassium ions or ammonium ions.

The calcium salt is one or two of calcium citrate, calcium citrate tetrahydrate, and tricalcium dicitrate, preferably calcium citrate tetrahydrate. Calcium chloride can also be used, but the effect of calcium chloride is not as good as that of calcium citrate tetrahydrate.

The protease and lipase are commercially available protease and lipase. Although the enzyme activity and the concentration are different in various enzyme preparations, the encapsulated ratio is in accordance with the concentration of protein. The amount of protease or lipase to be added is suggested to be not greater than 600 mg protein per gram of conjugated linoleic acid. The concentration may be increased or decreased on this basis, depending upon the protease or lipase used.

The liquid laundry detergent is a concentrated liquid laundry detergent with surfactants as main substance and the surfactant concentration is between 20 wt %-50 wt %.

"well shaking the two solutions by a shaker at a certain temperature" means shaking at 20-30° C.

"A certain amount of [3-(3,4-dimethyl-9-oxo-9-hydro-thioxanthene-2-oxy)-2-hydroxypropyl] trimethylammonium chloride (QTX) solution" refers to the solution using a same buffer as that for the conjugated linoleic acid buffer solution, and the amount of the QTX used is 0.05 wt %-0.12 wt % of mass of conjugated linoleic acid used, preferably 0.10 wt %.

For "radiating by an ultraviolet spot light at a certain temperature", there is no special requirements on the ultraviolet spot light and professional ultraviolet spot light products may be used (for example, a high-intensity spot light: model Power Arc UV 100, 350-450 nm, maximum abs at 365 nm, power of 200 W and illumination intensity of 16 $W/cm^2$; or a UV-LED spot light: 365 nm, power of 60 W, illumination intensity of 8 $W/cm^2$; or an LT-102 curing machine: 250-370 nm, power adjustable at 1-2 KW). The distance from the reactor to the spot light is adjustable according to other selected technical parameters such as light intensity, the quantity of reactants, illumination time. The reaction endpoint depends upon the cross-linking degree.

"until a desired cross-linking degree has been reached" means that desired cross-linking degree is between 35%-50%. If cross-linking degree is higher than this degree, the enzyme release time will be slowed down to 1.5 minute to 2.5 minute in areas where the $CaCO_3$ hardness of tap water is lower than 80 ppm. This has little influence on the use effect. It is not applicable to manual washing with softened water.

The encapsulation rate can be determined by conventional approaches. The total activity of free enzymes added in the vesicle and the activity of free enzymes in the supernatant after microencapsulation are measured, respectively. The enzyme encapsulation rate is calculated as follows:

$$\text{Encapsulation rate} = \frac{\left(\begin{array}{c}\text{total activity of the}\\ \text{initially-added enzymes}\\ -\\ \text{total activity of enzymes}\\ \text{in the supernatant}\end{array}\right)\times 100\%}{\begin{array}{c}\text{total activity of the}\\ \text{initailly-added enzymes}\end{array}}$$

The protease activity is determined with the Fulin casein assay, while the lipase activity is tested with the assay of olive oil hydrolysis. Other enzyme activity measurement methods suggested by the suppliers can be used certainly.

"The enzyme activity release rate after a period of time" is calculated as the total enzyme activity measured in tap water washing solution after a period of time divided by the total calculated activity of enzymes initially added in the tap water washing solution×100%.

"The enzyme activity retention rate after a period of time" is calculated as the total enzyme activity measured in the liquid laundry detergent after a period of time divided by the total calculated activity of enzymes initially added in the liquid laundry detergent×100%.

The total calculated enzyme activity refers to the enzyme activity calculated according to specific activity and mass of the initially measured free enzyme or immobilized enzyme.

The cross-linking degree can be measured and calculated as follows: the vesicle solution sample is diluted to 0.06 mmol/L with a buffer solution of pH 8.6 for measuring absorbance $A_{234}$; while a calibration standard absorption curve of the absorbance $A_{234}$ and concentration of conjugated linoleic acid solution is used to calculate the concentrations of conjugated linoleic acid in the vesicle solution before and after radiation; i.e. the cross-linking degree is calculated according to the concentration of the remained free conjugated linoleic acid:

$$\text{Cross-linking degree} = \frac{\left(\begin{array}{c}\text{the concentration of conjugated linoleic acid}\\ \text{in the solution before reaction}\\ -\\ \text{the concentration of conjugated linoleic acid}\\ \text{in the solution after reaction}\end{array}\right)\times 100\%}{\begin{array}{c}\text{the concentration of conjugated linoleic acid}\\ \text{in the solution before reaction}\end{array}}$$

Beneficial effects of the present invention:

(1) Lipase and protease can be separately stored in liquid laundry detergents to prevent the degradation of lipase by protease.

(2) The enzymatic vesicles can be either stabilized in enzymatic detergent or broken rapidly in laundry use to release lipase and protease, due to the difference of $Ca^{2+}$ concentration in the liquid laundry detergent and in the environment where the enzymatic liquid laundry detergent is used. It is easy and practical to use.

(3) The enzymatic vesicles are stabilized by partially cross-linking, without adding any non-ionic surfactants or co-surfactants to stabilize the vesicles.

(4) This method is applicable to neutral and alkaline enzymes.

(5) This method provides high encapsulation rate so that the stabilization of lipase and protease in high-concentration liquid laundry detergents is significantly improved.

(6) This method also provides high stabilization of enzymatic vesicles in high-concentration liquid laundry detergent. The conjugated linoleates used in the present disclosure are surfactants with detergency and are highly compatible with the popular surfactants in liquid laundry detergents. The enzyme encapsulation and release of the conjugated linoleates is better than that of polysaccharides of high molecular weight such as pectin and sodium alginate.

(7) The preparation process is easy to conduct, and the used devices and synthesis methods are common.

DETAILED DESCRIPTION

The formula of the liquid laundry detergent used in Embodiments 1-3 is as follows (in percentage by dry base):

AES (fatty alcohol polyoxyethylene ether sodium sulfate): 21.5%;
AEO-7 (fatty alcohol polyoxyethylene ether-7): 2.5%;
AEO-9 (fatty alcohol polyoxyethylene ether-9): 2.5%;
Trisodium citrate: 3.5%;
Polyether defoamer: 0.05%;
Citric acid: 0.1%;
NaCl: 0.5%;
Fluorescent brightener: 0.14%;
Kathon: 0.05%;
Essence (lemon flavor): 0.1%; and
Water to make up to volume,
pH=7.5.

The formula of the liquid laundry detergent used in Embodiments 4-6 is as follows (in percentage by dry weight):

AES: 29%;
coconut oil polyoxyethylene ether-9: 8%;
AEO-9: 5.5%;
AEO-7: 2.5%;
Trisodium citrate: 3.5%;
Polyether defoamer: 0.05%;
Citric acid: 0.1%;
NaCl: 0.5%;
Fluorescent brightener: 0.14%;
Kathon: 0.05%;
Essence (lemon flavor): 0.1%; and
Water to make up to volume,
pH=7.4.

These formulae are similar to those of most commercially available liquid laundry detergents. The formulae may be modified as needed. Modifications on the formulae have little influence on the performance of stabilizing both protease and lipase provided in the present disclosure. The protease and lipase used in the following embodiments are all commercially available enzymes, some of which have been concentrated in the laboratory. The method of the present disclosure is not limited to proteases and lipases to be mentioned in the following embodiments.

Embodiment 1

A Method for Stabilizing Both Alkaline Protease 2709 and *Pseudomonas aeruginosa* Lipase in a Liquid Enzymatic Laundry Detergent Vesicles encapsulated alkaline protease 2709 (909.1 mg protein/g, produced by Xintai Sinobest Biotech Co., Ltd., China) and vesicles encapsulated *Pseudomonas aeruginosa* lipase (839.6 mg protein/g, provided by Renewable Energy Laboratory, School of biotechnology, Jiangnan University, P.R. China) were respectively prepared and used as follows:

(1) 11.52 g of conjugated linoleic acid was dissolved in 200 mL of sodium dihydrogen phosphate-disodium hydrogen phosphate buffer (pH 8.6, 0.01 mol/L) containing 0.25 mmol/L calcium citrate at room temperature, and mixed well; the solution was then divided into two halves, 3.17 g of alkaline protease 2709 was added in one half and 3.43 g of *Pseudomonas aeruginosa* lipase was added in another half; and, each of the two solutions was shaken in dark for 4 hours (at a shaking speed of 50 rpm) by a shaker at 25° C., to obtain two solutions of conjugated linoleic acid vesicles encapsulated enzyme, wherein the protease encapsulation rate was 91.2% and the lipase encapsulation rate was 92.3%.

(2) The above two solutions of enzymatic vesicles were mixed in a cylindrical glass reactor (height-diameter ratio of 2:1) equipped with a stopper and a magnetic stirrer, and then the QTX solution of 0.06 wt. % of conjugated linoleic acid was then added in dark; oxygen was discharged by nitrogen sweeping for 20 minutes into the reactor before sealing the reactor. The solution was stirred under radiation by an ultraviolet spot light for 20 minutes at 25° C. The radiation is stopped when the cross-linking degree reached 36.2%. In this way, a solution of partially cross-linked conjugated linoleic acid vesicles encapsulated enzymes was obtained.

(3) The above vesicle solution was concentrated with lyophilization until the water content reached 10%. The obtained enzymatic vesicles were added in the liquid laundry detergent in a proportion of 4 wt %. After 8 weeks at 25° C., in the liquid laundry detergent, the retention rate of protease activity was 85% and the retention rate of lipase activity was 84%. After six months, in the liquid laundry detergent, the retention rate of protease activity was 55% and the retention rate of lipase activity was 59%. 1 g of the liquid enzymatic laundry detergent was dispersed into 1 L tap water (hardness of 98 ppm, calculated in form of calcium carbonate), and after 1 min, the release rate of protease activity was 99.8% and the release rate of lipase activity was 100.1% in the solution.

Comparison Example 1

Alkaline Protease 2709 and *Pseudomonas aeruginosa* Lipase were Directly Added in the Liquid Laundry Detergent.

0.78 g of alkaline protease 2709 and 0.84 g of *Pseudomonas aeruginosa* lipase were added together in 100 g of the liquid laundry detergent, and mixed well. After 8 weeks at 25° C., in the liquid laundry detergent, the retention rate of protease activity was 38% and the retention rate of lipase activity was 9%. After six months, the retention rate of protease activity was 31% and the retention rate of lipase activity was 3%. 1 g of the liquid enzymatic laundry detergent was dispersed into 1 L tap water, at 25° C. and after 1 min, the release rate of protease activity was 99.2% and the release rate of lipase activity was 100.3% in the solution.

Comparison Example 2

Alkaline Protease 2709 and *Pseudomonas aeruginosa* Lipase were Stabilized by Sodium Alginate and Calcium Chloride.

3.17 g of alkaline protease 2709 solution and 3.43 g of *Pseudomonas aeruginosa* lipase solution were added, respectively, into 100 mL of the 3% sodium alginate solution under stirring. The enzyme solutions were slowly added into the 3% calcium chloride solution dropwise using a sterile syringe to obtain gel microspheres, respectively. The solution of gel microspheres was placed overnight at 40° C. for further hardening. The hardened gel microspheres were then obtained by vacuum filtration. The hardened gel microspheres were washed three times with sterile saline solution to remove calcium carbonate on the microsphere surfaces and then naturally dried until the water content reached 50%.

10 g of the protease gel microspheres and 10 g of the lipase gel microspheres were added into 100 g of the liquid laundry detergent and mixed well. After 8 weeks at 25° C., the retention rate of protease activity was 40.8% and the retention rate of the lipase activity was 14.6%. After six months, the retention rate of protease activity was 28% and the retention rate of lipase activity was 7%. 1.2 g of the liquid enzymatic laundry detergent was dispersed into 1 L tap water, at 25° C. and after 1 min, the release rate of protease activity was 10.2% and the release rate of lipase activity was 16.1% in the solution.

Embodiment 2

A method for Stabilizing Both *Serratia marcescens* Alkaline Protease and *Pseudomonas aeruginosa* Lipase in Liquid Enzymatic Laundry Detergent Vesicles encapsulated *Serratia marcescens* alkaline protease (930.2 mg protein/g, from *Serratia marcescens*) and vesicles encapsulated *Pseudomonas aeruginosa* lipase (839.6 mg protein/g, provided by Renewable Energy Laboratory, Scholl of Biotechnology, Jiangnan University, China) were respectively prepared and used as follows:

(1) Conjugated linoleic acid and calcium citrate were dissolved and mixed well in 0.01 mol/L borax buffer (pH 9.18) at room temperature. The final concentration of conjugated linoleic acid was 300 mmol/L and the concentration of calcium salt was 0.15 mmol/L. 5.25 g of *Serratia marcescens* alkaline protease and 5.81 g of *Pseudomonas aeruginosa* lipase were added, respectively, in 100 mL of the solution. That is, the amount of enzymes added in the solution was 565 mg protein per grain of conjugated linoleic acid. Each of the two solutions was mixed well, shaken for 6 hours by a shaker (at a shaking speed of 45 rpm) at 22° C., and self-assembled to obtain two solutions of conjugated linoleic acid vesicles encapsulated protease and lipase respectively, wherein the protease encapsulation rate was 92.5% and the lipase encapsulation rate was 93.2%.

(2) The above two self-assembled solutions of conjugated linoleic acid vesicles encapsulated protease and lipase, obtained in the step (1), were placed together in the reactor. QTX solution of 0.065 wt % of the mass of conjugated linoleic acid, was then added in dark; and then the reactor was sealed after 20 minutes of nitrogen sweeping. The solution in the reactor was stirred under radiation by an ultraviolet spot light to partially cross-link conjugated linoleic acid. The radiation is stopped when the cross-linking degree reached 46.6%. In this way, a solution of partially cross-linked conjugated linoleic acid vesicles encapsulated protease and lipase was obtained. The above solution was concentrated with lyophilization until the water content reached 12%, and the obtained enzymatic vesicles were added directly into the liquid laundry detergent in a proportion of 3 wt %. After 8 weeks at 25° C., in the liquid laundry detergent, the retention rate of protease activity was 91.56% and the retention rate of lipase activity was 92.7%. 1 g of the liquid enzymatic laundry detergent was dispersed into 1 L tap water (hardness of 110 ppm, calculated in form of calcium carbonate), and after 1 min, the release rate of protease activity was 97.8% and the release rate of lipase activity was 100.1% in the solution.

Embodiment 3

A Method for Stabilizing Both Neutral Protease 1398 and Conn Alkaline Lipase in Liquid Enzymatic Laundry Detergent Vesicles encapsulated neutral protease 1398 (905.7 mg protein/g, provided by Xintai Sinobest Biotech Co., Ltd., China) and vesicles encapsulated alkaline lipase (860.3 mg protein/g, provided by Shenzhen Earth Conn Biological Technology Co., Ltd., China) were respectively prepared and used as follows:

(1) Conjugated linoleic acid and calcium citrate tetrahydrate were dissolved in 0.01 mol/L disodium hydrogen phosphate-citric acid buffer (pH 8) at room temperature. The final concentration of conjugated linoleic acid was 240 mmol/L and the concentration of calcium salts was 0.25 mmol/L. After they were mixed well, 4.04 g of neutral protease 1398 and 4.26 g of lipase were added, respectively, into 100 mL of the solution. That is, the amount of neutral protease and lipase added in each solution was 585 mg protein per gram of conjugated linoleic acid. Each of the two solutions was shaken for 5.5 hours by a shaker (at a shaking speed of 50 rpm) at 25° C., and self-assembled to obtain two solutions of conjugated linoleic acid vesicles encapsulated protease and lipase, wherein the protease encapsulation rate was 91.9% and the lipase encapsulation rate was 90.7%.

(2) The above two self-assembled solutions of conjugated linoleic acid vesicles encapsulated protease and lipase, obtained in the step (1), were placed together in a reactor; the QTX solution of 0.075 wt. % of the mass of conjugated linoleic acid was then added in dark; and then the reactor was sealed after 23 minutes of nitrogen sweeping. The solution in the reactor was stirred under radiation by an ultraviolet spot light to partially cross-link conjugated linoleic acid. The radiation is stopped when the cross-linking degree reached 48.9%. Therefore, a solution of partially cross-linked conjugated linoleic acid vesicles encapsulated both protease and lipase was obtained. The above solution was concentrated with lyophilization until the water content reached 12%, and the obtained enzymatic vesicles were added directly into the liquid laundry detergent in a proportion of 3 wt %. After 8 weeks at 25° C., in the liquid laundry detergent, the retention rate of protease activity was 83.9% and the retention rate of lipase activity was 87.8%.

1 g of the liquid enzymatic laundry detergent was dispersed into 1 L tap, water (hardness of 105 ppm, calculated in form of calcium carbonate), and after 1 min, the release rate of protease activity was 100.3% in the solution.

Embodiment 4

A Method for Stabilizing Both Alkaline Protease 2709 and Conn Alkaline Lipase in Liquid Enzymatic Laundry Detergent The alkaline protease 2709 and Conn alkaline lipase were encapsulated and used as follows:

(1) Conjugated linoleic acid, a same amount of calcium citrate tetrahydrate and tricalcium dicitrate were dissolved in 0.01 mol/L borax buffer solution (pH 9.0) at room temperature, and mixed well. The final concentration of conjugated linoleic acid was 255 mmol/L and the concentration of calcium salts was 0.28 mmol/L. Then, 4.77 g of alkaline protease 2709 and 5.04 g of Conn alkaline lipase were added, respectively, into 100 mL of the solution. The amount of alkaline protease and lipase added in the solution each was 600 mg protein per gram of conjugated linoleic acid. Each of the two solutions was shaken individually for 8 hours by a shaker (at a shaking speed of 50 rpm) at 30° C., and self-assembled to obtain two solutions of conjugated linoleic acid vesicles encapsulated protease and lipase, wherein the encapsulation rate was 92.4% for the protease and 91.5% for the lipase.

(2) The above two self-assembled solutions of conjugated linoleic acid vesicles encapsulated protease and lipase, obtained in the step (1), were placed together in a reactor; the QTX solution of 0.12% of the mass of conjugated linoleic acid was then added in dark, and then the reactor was sealed after 25 minutes of nitrogen sweeping. The solution in the reactor was stirred under radiation by an ultraviolet spot light to partially cross-link conjugated linoleic acid. The radiation is stopped when the cross-linking degree reached 46%. In this way, a solution of partially cross-linked conjugated linoleic acid vesicles encapsulated protease and lipase was obtained. The above solution was concentrated with lyophilization until the water content reached 13%, and the obtained mixture of vesicles encapsulated protease and vesicles encapsulated lipase was added directly in the liquid laundry detergent in a proportion of 2.9 wt %. After 8 weeks at 25° C., in the liquid laundry detergent, the retention rate of protease activity was 80.8% and the retention rate of lipase activity was 79.9%. 1 g of the liquid enzymatic laundry detergent was dispersed into 1 L tap water (hardness of 110 ppm, calculated in form of calcium carbonate), 1 min after, the release rate of protease activity was 100.1% and the release rate of lipase activity was 100.2% in the solution.

Comparison Example

The two enzymes were directly added in the liquid laundry detergent.

0.8 g of each enzyme was added in the liquid laundry detergent. After 8 weeks at 25° C., the retention rate of protease activity was 46% and the retention rate of lipase activity was 6.7%. 1 g of the liquid enzymatic laundry detergent was dispersed into 1 L tap water, and after 1 min, the measured release rate of protease activity was 99.8% and the release rate of lipase activity was 99.1% in the solution.

Embodiment 5

A Method for Stabilizing Both Neutral Protease 1398 and *Pseudomonas aeruginosa* Lipase in Liquid Enzymatic Laundry Detergent vesicles encapsulated neutral protease 1398 and vesicles encapsulated *Pseudomonas aeruginosa* lipase were respectively prepared and used as follows:

(1) Conjugated linoleic acid and calcium chloride were added into 0.015 mol/L disodium hydrogen phosphate-citric acid buffer solution (pH 7.0) at room temperature, and mixed well. The final concentration of conjugated linoleic acid was 310 mmol/L and the concentration of calcium salts was 0.25 mmol/L. 4.25 g of neutral protease 1398 and 4.59 g of the lipase were added, respectively, into 100 mL of the above solution. That is, the amount of neutral protease and lipase added in the solution each was 570 mg protein per gram of conjugated linoleic acid. Each of the two solutions was mixed well, shaken for 8 hours by a shaker (at a shaking speed of 45 rpm) at 20° C., and self-assembled to obtain two solutions of conjugated linoleic acid vesicles encapsulated enzyme, wherein the encapsulation rate was 93.7% for the protease and was 90.8% for the lipase, respectively.

(2) The above two self-assembled solutions of conjugated linoleic acid vesicles encapsulated protease and lipase, obtained in the step (1), were placed together in a reactor; the QTX solution of 0.10% of the mass of conjugated linoleic acid was then added in dark; and then the reactor was sealed after 20 minutes of nitrogen sweeping. The solution in the reactor was stirred under radiation by an ultraviolet spot light to partially cross-link conjugated linoleic acid. The radiation is stopped when the cross-linking degree reached 50%. In this way, a solution of partially cross-linked conjugated linoleic acid vesicles encapsulated protease and lipase was obtained. The above solution was concentrated with lyophilization until the water content reached 14%, and the obtained mixture of vesicles encapsulated protease and vesicles encapsulated lipase was added directly in the liquid laundry detergent in a proportion of 6 wt %. After 8 weeks at 25° C., the retention rate of protease activity was 85.2% and the retention rate of lipase activity was 82.1%. 1 g of the liquid enzymatic laundry detergent was dispersed into 1 L tap water (hardness of 98 ppm, calculated in form of calcium carbonate), and after 1 min, the measured release rate of protease activity was 94%.

Embodiment 6

A Method for Stabilizing Both Alkaline Protease 2709 and Conn Alkaline Lipase in Liquid Enzymatic Laundry Detergent Vesicles encapsulated alkaline protease 2709 and vesicles encapsulated Conn alkaline lipase were respectively prepared and used as follows:

(1) Conjugated linoleic acid and calcium chloride were added into 0.01 mol/L borax-sodium hydroxide buffer solution (pH 10.0) at room temperature, and mixed well. The final concentration of conjugated linoleic acid was 590 mmol/L and the concentration of calcium salts was 0.30 mmol/L. After they were mixed well, 10.37 g of alkaline protease 2709 and 10.96 g of Conn alkaline lipase were added, respectively, into 100 mL of the solution. That is, the amount of alkaline protease and lipase added in the solution each was 550 mg protein per gram of conjugated linoleic acid. Each of the two solutions was shaken respectively for 7 hours by a shaker (at a shaking speed of 50 rpm) at 22° C., and self-assembled to obtain two solutions of conjugated linoleic acid vesicles encapsulated enzymes, wherein the protease encapsulation rate was 91.9% and the lipase encapsulation rate was 90.7%.

(2) The above two self-assembled solutions of conjugated linoleic acid vesicles encapsulated protease and lipase, obtained in the step (1), were together placed in a reactor; the QTX solution of 0.10% of the mass of conjugated linoleic acid was then added in dark; and then the reactor was sealed after 25 minutes of nitrogen sweeping. The solution in the reactor was stirred under radiation by an ultraviolet spot light to partially cross-link conjugated linoleic acid. The radiation is stopped when the cross-linking degree reached 35%. In this way, a solution of partially cross-linked conjugated linoleic acid vesicles encapsulated protease and lipase was obtained. The above solution was concentrated with lyophilization until the water content reached 13%. The obtained mixture of vesicles encapsulated protease and vesicles encapsulated lipase was added directly in the liquid laundry detergent in a proportion of 1.5 wt %. After 8 weeks at 25° C., the retention rate of protease activity was 82.3% and the retention rate of lipase activity was 85.1%. 1 g of the liquid enzymatic laundry detergent was dispersed into 1 L tap water (hardness of 98 ppm, calculated in form of calcium carbonate), and after 1 min, the release rate of protease activity was 99.2% and the release rate of lipase activity was 98.9% in the solution.

Although the present invention has been disclosed above by preferred embodiments, the present invention is not limited thereto. Various changes and improvements may be made by those skilled in the art without departing from the spirit of the present invention. Therefore, the protection scope of the present invention shall be subject to that defined by the appended claims.

What is claimed is:

1. A method for stabilizing both lipase and protease in a liquid enzymatic laundry detergent, comprising steps of: self-assembling, in a buffer solution at room temperature, containing conjugated linoleic acid and calcium salts; subsequently adding a protease solution and a lipase solution respectively into the buffer solution; followed by shaking with a shaker at 20-30° C. and 50 rpm until the encapsulation rates no longer increase; wherein the self-assembly step yields a solution of conjugated linoleic acid vesicles encapsulated protease and a solution of conjugated linoleic acid vesicles encapsulated lipase; and a step (b) of mixing the solution of conjugated linoleic acid vesicles encapsulated protease and the solution of conjugated linoleic acid vesicles encapsulated lipase to produce a mixture, and placing the mixed solution mixture in a reactor equipped with a magnetic stirrer and a stopper; adding [3-(3,4-dimethyl-9-oxo-9-hydrothioxanthene-2-oxy)-2-hydroxypropyl] trimethylammonium chloride solution in dark; and then conducting nitrogen sweeping into the reactor for 20-25 minutes; sealing the reactor, stirring the solution and then radiating by an ultraviolet spot light to partially cross-link conjugated linoleic acid, and stop radiation when reaching a certain cross-linking degree; thus a solution of enzymatic vesicles was obtained in which the partially cross-linked conjugated linoleic acid serve as wall material and the enzymes serve as core material; and afterwards, lyophilizing to concentrate the solution of enzymatic vesicles to reach a water content of 10%-15%, and then adding the solution of enzymatic vesicles directly into a liquid laundry detergent to obtain liquid enzymatic laundry detergent in which both protease and lipase can maintain their enzyme activities in the liquid laundry detergent when the liquid laundry detergent is stored; and in tap water use, the vesicles rupture to release protease and lipase rapidly.

2. The method for stabilizing both protease and lipase in a liquid enzymatic laundry detergent according to claim 1, wherein the calcium salt is one or a mixture of two of calcium citrate, calcium citrate tetrahydrate, and tricalcium dicitrate.

3. The method for stabilizing both protease and lipase in a liquid enzymatic laundry detergent according to claim 1, wherein the concentration of the calcium salts is 0.1-0.30 $mmol \cdot L^{-1}$.

4. The method for stabilizing both protease and lipase in a liquid enzymatic laundry detergent according to claim 1, wherein with regard to the partial cross-linking of conjugated linoleic acid, stop radiating when reaching a certain cross-linking degree means stop cross-linking when the cross-linking degree reaches 35%-50%.

5. The method for stabilizing both protease and lipase in liquid enzymatic laundry detergent according to claim 1, wherein the liquid laundry detergent is a concentrated liquid laundry detergent with surfactants as main material and the surfactant concentration is between 20 wt % and 50 wt %.

6. The method for stabilizing both protease and lipase in liquid enzymatic laundry detergent according to claim 1, wherein the final concentration of conjugated linoleic acid is 200-600 $mmol \cdot L^{-1}$.

7. The method for stabilizing both protease and lipase in liquid enzymatic laundry detergent according to claim 1, wherein the amount of the protease or the lipase added is not more than 600 mg protein per gram of conjugated linoleic acid.

8. The method for stabilizing both protease and lipase in liquid enzymatic laundry detergent according to claim 1, wherein pH of the buffer solution ranges from 7.0 to 10.0;

the citric acid-citrate and the cation in the buffer solution is one of sodium ion, potassium ion and ammonium ion.

9. The method for stabilizing both protease and lipase in the liquid enzymatic laundry detergent according to claim 1, wherein solvents for dissolving [3-(3,4-dimethyl-9-oxo-9-hydro-thioxanthene-2-oxy)-2-hydroxypropyl] trimethylammonium chloride and conjugated linoleic acid are same; and the amount of [3-(3,4-dimethyl-9-oxo-9-hydro-thioxanthene-2-oxy)-2-hydroxypropyl] trimethylammonium chloride used is 0.05 wt %-0.10 wt % of that of conjugated linoleic acid.

* * * * *